US008336870B2

(12) United States Patent
Kobayashi

(10) Patent No.: US 8,336,870 B2
(45) Date of Patent: Dec. 25, 2012

(54) BUNDLE-STATE DETECTION APPARATUS AND SEPARATION AND EXTRACTION APPARATUS

(75) Inventor: Yuko Kobayashi, Kawasaki (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 13/358,679

(22) Filed: Jan. 26, 2012

(65) Prior Publication Data

US 2012/0154795 A1 Jun. 21, 2012

Related U.S. Application Data

(63) Continuation of application No. PCT/JP2009/063579, filed on Jul. 30, 2009.

(51) Int. Cl.
*B65H 5/00* (2006.01)

(52) U.S. Cl. ..... 271/10.01; 271/97; 271/96

(58) Field of Classification Search ..... 271/10.01, 271/97, 98

See application file for complete search history.

(56) References Cited

U.S. PATENT DOCUMENTS 7,663,769 B2 2/2010 Hayashihara et al.
7,694,957 B2 4/2010 Nukada et al.
7,708,268 B2 5/2010 Toya et al.
7,802,785 B2 9/2010 Kobayashi et al.
2001/0017441 A1* 8/2001 Yamaguchi et al. ..... 271/94

FOREIGN PATENT DOCUMENTS

| | | |
|---|---|---|
| JP | 61-295934 | 12/1986 |
| JP | 2002-249250 | 9/2002 |
| JP | 2004-359449 | 12/2004 |
| JP | 2006-225087 | 8/2006 |
| JP | 2007-145567 | 6/2007 |

OTHER PUBLICATIONS

International Search Report for International Application No. PCT/JP2009/063579 mailed on Sep. 1, 2009.
Written Opinion for International Application No. PCT/JP2009/063579.

* cited by examiner

*Primary Examiner* — David H Bollinger
(74) *Attorney, Agent, or Firm* — Turocy & Watson, LLP

(57) ABSTRACT

According to one embodiment, a separation and extraction apparatus includes an extraction unit, separation unit, air supply mechanism, detector, and controller. The extraction unit extracts and conveys one or more paper sheets from a stack of paper sheets. The separation unit separates one paper sheet from the other paper sheet(s) of the one or more paper sheets. The air supply mechanism supplies air toward a side surface of the stack. The detector detects a bundle state of the stack, which is related to a contact state between the paper sheets. The controller sets an extraction condition depending on the bundle state, which includes drive conditions for the extraction unit, separation unit, and air supply mechanism.

7 Claims, 16 Drawing Sheets

BUNDLE-STATE DETECTION APPARATUS AND SEPARATION AND EXTRACTION APPARATUS

CROSS-REFERENCE TO RELATED APPLICATIONS

This application is a Continuation Application of PCT Application No. PCT/JP2009/063579, filed Jul. 30, 2009, the entire contents of which are incorporated herein by reference.

FIELD

Embodiments described herein relate generally to a bundle-state detection apparatus and a separation and extraction apparatus.

BACKGROUND

Apparatuses, such as a copier, a printer, an automated teller machine (ATM), a banknote processor, and a postal article processor, deal with paper sheets (or paper-like media), such as printing papers, banknotes, copy papers, post cards, envelopes, and stock notes. These apparatuses are required to extract one paper sheet after another from a stack of paper sheets. Therefore, these apparatuses each include a separation and extraction apparatus which separates a paper sheet from a stack of paper sheets and extract the paper sheet from the stack.

The separation and extraction apparatus needs to precisely extract one paper sheet after another from a stack of paper sheets without extracting multiple paper sheets. Conventionally, in order to separate and extract a paper sheet, a stack is loosened by blowing air at a side surface of the stack (also called the sheet bundle). However, for use in an automated teller machine, the separation and extraction apparatus needs to handle, for example, a stack of brand-new banknotes in which paper sheets are placed in firm contact with each other, a stack of circulated banknotes which are creased, wrinkled, and soft, and a stack of these banknotes which are stacked on and mixed with each other. Therefore, in order to steadily separate and extract one after another from such a stack of banknotes, for example, the stack needs to be handled adequately by controlling a flow rate and a pressure of the blown air, depending on the bundle state of the stack.

Further, JP-A 2007-145567 (Patent Document 1) discloses a separation and extraction apparatus in which a vibration unit is put in contact with an upper surface of a stack and a contact force between one another of paper sheets is reduced by vibrating the stack, to extract one paper sheet after another. In such a separation and extraction apparatus, the paper sheets each are extracted with friction sufficiently reduced between an uppermost paper sheet in the stack and another paper sheet just below the uppermost paper sheet by utilizing high-frequency vibration. Extraction of multiple paper sheets (i.e., a multiple feed) is thus prevented. Another separation and extraction apparatus which also utilizes high-frequency vibration is of a type in which the high-frequency vibration triggers separation of paper sheets. In this state, air is blown at a side surface of a stack of the paper sheets to improve extraction performance.

However, the separation and extraction apparatus disclosed in Patent Document 1 can not much improve the extraction performance if paper sheets in a stack are originally not in firm contact with one another, like a stack of wrinkled or creased paper sheets stacked on one another. The separation and extraction apparatus may rather cause a risk that paper sheets are damaged by extracting at a high speed with a tip end of the vibration unit stuck on the paper sheets.

Accordingly, a bundle-state detection apparatus which is capable of detecting a bundle state of a stack of paper sheets is demanded. Further, a separation and extraction apparatus including such a bundle-state detection apparatus is demanded to stably extract one paper sheet after another.

DETAILED DESCRIPTION

In general, according to one embodiment, a separation and extraction apparatus comprises a support unit, an extraction unit, a separation unit, an air supply mechanism, a detector, and a controller. The support unit is configured to support a stack of paper sheets stacked in a stacking direction. The stack has an upper surface, a lower surface, and a plurality of side surfaces extending in the stacking direction. The extraction unit is configured to extract one or more paper sheets from the stack and convey the one or more paper sheets. The separation unit is configured to separate one paper sheet from the other paper sheet or paper sheets of the one or more paper sheets. The air supply mechanism is configured to supply air toward a first surface selected from the side surfaces. The detector is configured to detect a bundle state of the stack. The bundle state is related to a contact state between the paper sheets. The controller is configured to set an extraction condition depending on the bundle state. The extraction condition includes a drive condition for the extraction unit, a drive condition for the separation unit, and a drive condition for the air supply mechanism.

Embodiments provide bundle-state detection apparatuses for detecting a bundle state of a stack of paper sheets. Further, embodiments provide separation and extraction apparatuses each including a bundle-state detection apparatus, which can extract one paper sheet after another from a stack of paper sheets by setting a separation/extraction condition (simply referred to as an extraction condition) depending on the detected bundle state.

Hereinafter, bundle-state detection apparatuses and separation and extraction apparatuses according to the embodiments will be described with reference to the accompanying drawings. Throughout the drawings, the same parts or the same portions as each other are respectively denoted at the same reference signs as each other, and detailed descriptions thereof will be omitted.

(First Embodiment)

Figure 1:
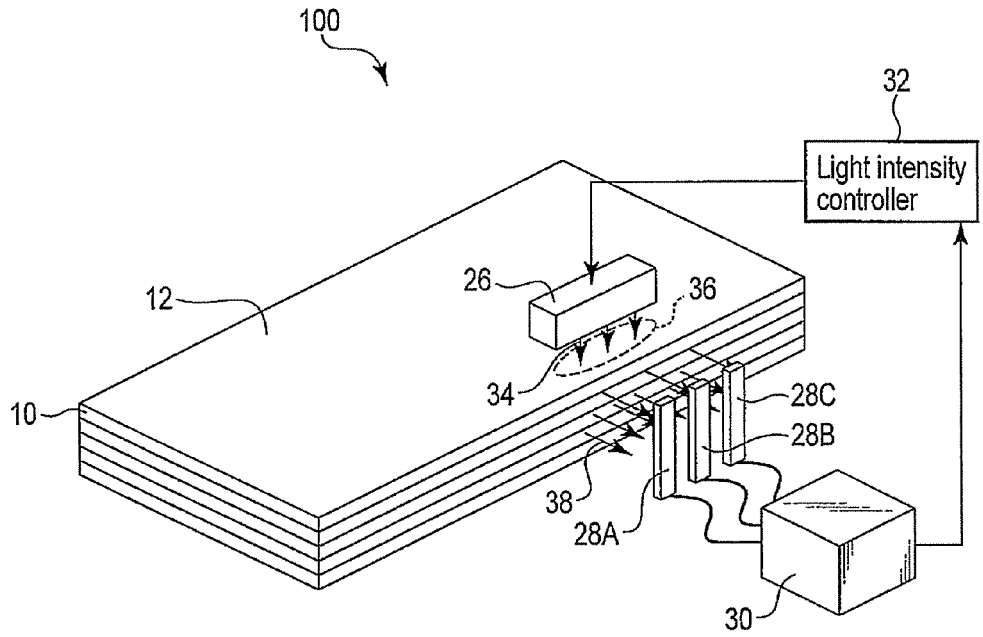
FIG. 1 is a perspective view showing a bundle-state detection apparatus according to a first embodiment.
Figure 2:
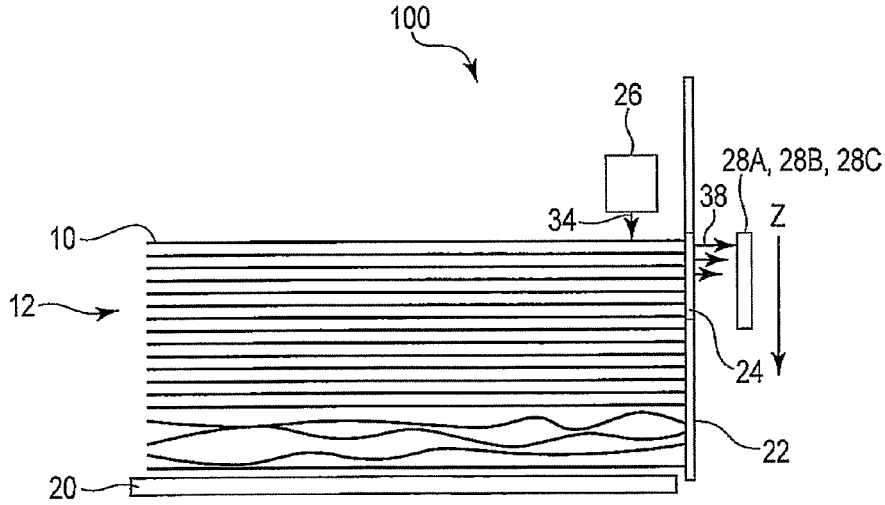
FIG. 2 is a cross-sectional view showing the bundle-state detection apparatus shown in FIG. 1.

FIGS. 1 and 2 are a perspective view and a cross-sectional view which show a schematic configuration of a bundle-state detection apparatus according to a first embodiment. As shown in FIG. 2, the bundle-state detection apparatus comprises a support table 20 on which a plurality of paper sheets (or paper-like media) 10 are stacked, i.e., a stack (also referred to as a sheet bundle) 12 is placed. On a surface of the stack 12 (hereinafter referred to as a side surface) extending along a stacking direction of stacking the paper sheets 10, a side guide 22 which supports the side surface of the stack 12 is provided. In the stack 12, end parts of individuals of the paper sheets 10 forming the stack 12 are put in contact with the side guide 22, and the paper sheets 10 are thereby aligned with one another. Since the stack 12 is normally formed by stacking paper sheets 10 each having a substantially rectangular shape, the stack 12 is shaped in a substantial cuboid insofar as the paper sheets 10 are aligned with one another. The side guide 22 is not limited to the example shown in FIG. 2, in which the side guide 22 is opposed to a side surface of the stack 12, but may be opposed to a plurality of side surfaces of the stack 12 in order to hold the stack 12.

Further, the bundle-state detection apparatus shown in FIG. 1 comprises a light emitting unit 26 which emits or irradiates an irradiation light beam 34 toward the stack 12. The light emitting unit 26 is, for example, arranged above the stack 12 and emits the irradiation light beam 34 toward a region 36 on an upper surface of the stack 12. The upper surface of the stack 12 is a surface opposed to a surface (namely a lower surface) in a side where the stack 12 is in contact with the support table (also referred to as the support unit) 20. The irradiation light beam 34 entering from the upper surface of the stack 12 propagates inside the stack 12 and is radiated from side surfaces of the stack 12. More specifically, the irradiation light beam 34 entering the stack 12 is reflected on surfaces of the individual paper sheets 10, penetrate the paper sheets 10, and scatter in directions to side surfaces while the irradiation light beam is absorbed in the paper sheets 10. As a result, the irradiation light beam 34 partially reaches the side surfaces of the stack 12 while being repeatedly reflected inside the stack 12, and is emitted as transmitted beam 38 from side surfaces of the stack 12. The transmitted beam 38 emitted from one of the side surfaces of the stack 12 is received by a light receiving unit arranged opposite to the side surface. The light receiving unit includes one or more (three in the example shown in FIG. 1) light receivers 28A, 28B, and 28C. Each of the light receivers 28A, 28, and 28C is formed of CCD image sensors one-dimensionally arrayed along the stacking direction (e.g., a direction indicated by an arrow Z in FIG. 2), and a lens unit which converges the transmitted beam 38 to form an image on the CCD image sensors. Each of the light receivers 28A, 28B, and 28C can detect a light intensity distribution along the stacking direction Z on the side surface of the stack 12. From the light receivers 28A, 28B, and 28C, light intensity distribution information indicating the detected light intensity distribution is transmitted to an information processing unit 30. The information processing unit 30 processes the light intensity distribution information to detect a bundle state of the stack 12, that is, detects a bundle state of the stack 12 based on the light intensity distribution information.

The light receiving unit for detecting the transmitted beam 38 is not limited to the example shown in FIG. 1 in which the plurality of light receivers 28A, 28B, and 28C form the light receiving unit. Only light intensity distributions along the stacking direction (i.e., thickness direction of the stack 12) need to be measured at a plurality of different regions on the side surface of the stack 12. For example, the light receiving unit may be formed of only one area sensor (for example, two-dimensionally arrayed CCD image sensors or CMOS image sensors). In this case, light intensity distributions are obtained at plurality of different regions based on the two-dimensional light intensity distribution detected by the area sensor.

As shown in FIG. 2, in the case where the side guide 22 is arranged between the stack 12 and the light receivers 28A, 28B, and 28C, a through hole 24 to allow the transmitted beam 38 to pass is formed at a part of the side guide 22 corresponding to positions where the light receivers 28A, 28B, and 28C are provided. The part of the side guide 22 corresponding to the positions where the light receivers 28A, 28B, and 28C are provided may be formed of a transparent material. In this case, the side guide 22 functions as a light shielding member by which the irradiation light beam 34 from the light emitting unit 26 is prevented from directly entering the light receivers 28A, 28B, and 28C. Accordingly, light intensity distributions at the side surface of the stack 12 can be measured accurately.

The light emitting unit 26 shown in FIG. 1 normally emits the irradiation light beam 34 with a substantially constant light intensity. However, the light intensity of the irradiation light beam 34 may be adjusted. For example, the light emitting unit 26 is electrically connected to a light intensity adjustment unit 32 which adjusts a light intensity of the irradiation light beam 34 irradiated from the light emitting unit 26. In this case, depending on, for example, types of paper sheets 10 stacked, the light intensity of the irradiation light beam 34 is adjusted. Further, the information processing unit 30 may instruct the light intensity adjustment unit 32 to adjust the light intensity of the irradiation light beam 34 emitted from the light emitting unit 26, depending on total amount of light received by the light receivers 28A, 28B, and 28C.

Figure 3A:
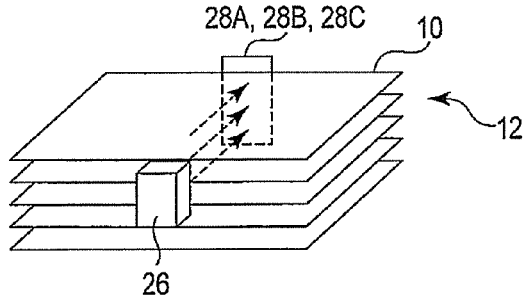
FIGS. 3A and 3B are perspective views showing a modification to a positional relationship between a light emitting unit and light receivers shown in FIG. 1.
Figure 3B:
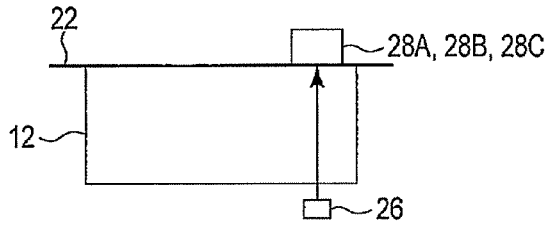
Figure 3C:
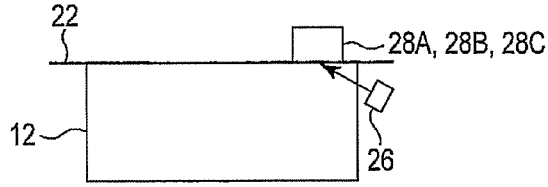
FIG. 3C is a perspective view showing another modification to a positional relationship between the light emitting unit and light receivers shown in FIG. 1.
Figure 3D:
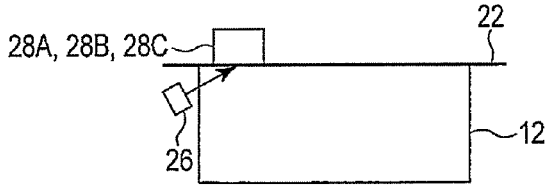
FIG. 3D is a perspective view showing a further modification to a positional relationship between the light emitting unit and light receivers shown in FIG. 1.

The light emitting unit 26 is not limited to the case of being arranged above the stack 12 as shown in FIG. 1 but may be arranged opposite to the lower surface or one of the side surfaces. In one example, the light emitting unit 26 may arranged opposite to the side surface so as to be opposed to the light receivers 28A, 28B, and 28C over the stack 12, as shown in FIGS. 3A and 3B. Alternatively, the light receivers 26 may be opposed to a side surface adjacent to the side surface where the light receiver 28A, 28B, and 28C are arranged, as shown in FIG. 3C or 3D. Since the irradiation light beam 34 which enters the stack 12 is attenuated in the stack, the light emitting unit 26 is desirably arranged near the light receivers 28A, 28B, and 28C in any cases.

Figure 4:
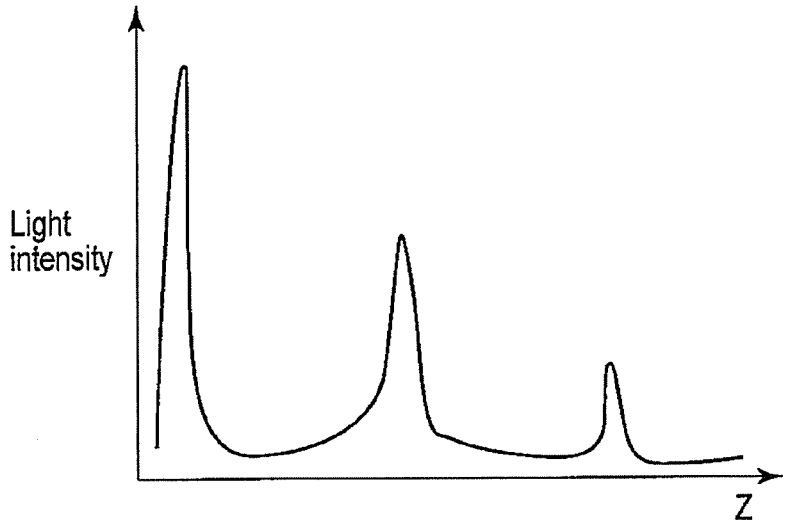
FIG. 4 is a schematic view showing a light intensity distribution detected by one of the light receivers shown in FIG. 1.

FIG. 4 shows an example of light intensity distribution of the transmitted beam 38 which is detected on a side surface of the stack 12. In a graph shown in FIG. 4, a lateral axis Z represents a distance along the stacking direction, and a longitudinal axis represents a detected light intensity. The light intensity distribution includes a plurality of peaks, as shown FIG. 4. In accordance with increase of Z, i.e., as a distance from the light emitting unit 26 increases, the light intensity exponentially attenuates. As described previously, the irradiation light beam 34 is repeatedly reflected between the paper sheets 10 while the beam is absorbed by the paper sheets 10. As a result, transmitted beams emitted from gaps between the paper sheets 10 one another have a relatively great light intensity, and transmitted beams emitted from ends of the paper sheets 10 have a relatively small light intensity. Therefore, in this light intensity distribution, parts where the light intensity is great correspond to gaps between the paper sheets 10, and parts where the light intensity is small correspond to the ends of the paper sheets 10.

Figure 5:
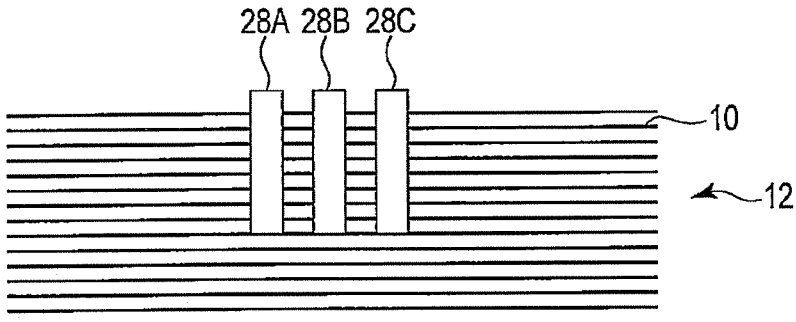
FIG. 5 is a side view schematically showing a stack of flat paper sheets stacked.
Figure 6A:
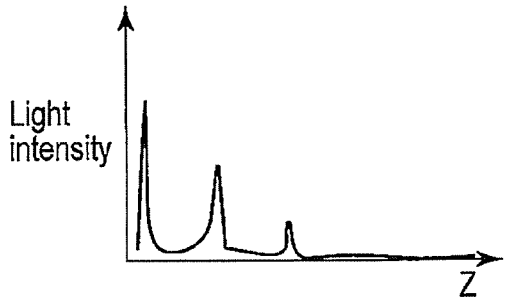
FIGS. 6A, 6B, and 6C are graphs showing light intensity distributions on a side surface of the stack shown in FIG. 5, which are detected by the light receivers shown in FIG. 5, respectively.
Figure 6B:
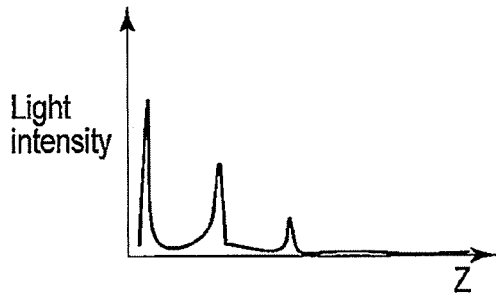
Figure 6C:
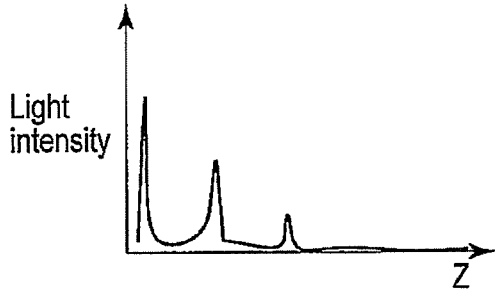

FIG. 5 schematically shows the stack 12 formed by stacking the paper sheets 10 which are neither wrinkled nor creased. FIGS. 6A, 6B, and 6C schematically show light intensity distributions on a side surface of the stack 12 shown in FIG. 5, which are detected by the light receivers 28A, 28B, and 28C, respectively. In the stack 12 of paper sheets 10 which are neither wrinkled nor creased or, namely, flat paper sheets 10, gaps between the paper sheets 10 on side surfaces of the stack 12 are kept substantially uniform between any adjacent paper sheets 10. In this case, as shown in FIGS. 6A, 6B, and 6C, light intensity distributions respectively measured by the light receivers 28A, 28A, and 28C substantially correspond to one another, and each of the light intensity distributions has a plurality of steep peaks which appear at substantially constant intervals.

Figure 7:
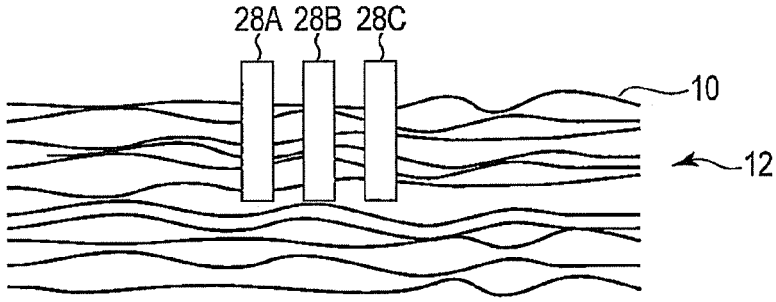
FIG. 7 is a side view schematically showing a stack of wrinkled paper sheets stacked.
Figure 8A:
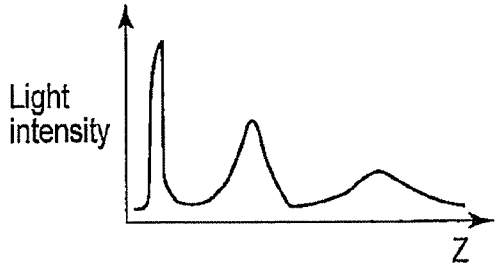
FIGS. 8A, 8B, and 8C are graphs showing light intensity distributions on a side surface of the stack shown in FIG. 7, which are detected by the light receivers shown in FIG. 7, respectively.
Figure 8B:
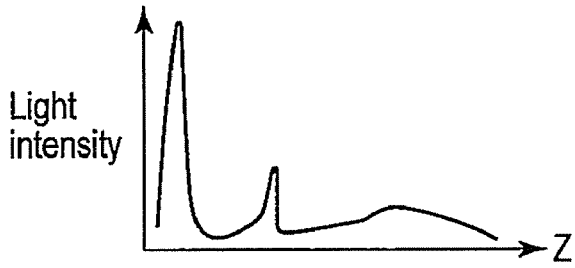
Figure 8C:
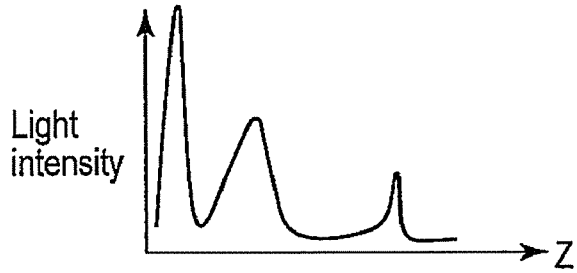

FIG. 7 schematically shows the stack 12 formed by stacking creased paper sheets 10 and wrinkled paper sheets 10. FIGS. 8A, 8B, and 8C schematically show light intensity distributions on a side surface of the stack 12 shown in FIG. 7, which are detected by the light receivers 28A, 28B, and 28C, respectively. In the stack 12 of paper sheets 10 which are wrinkled and creased, gaps between the paper sheets 10 on side surfaces of the stack 12 differ at different regions. In this case, as shown in FIGS. 8A, 8B, and 8C, each of light intensity distributions measured at different regions on a side of the stack 12 has peaks of light intensities appearing at different regions. In each of the light intensity distributions, intervals between the peaks vary, and further, parts corresponding to ends of the paper sheets 10 and small light intensities are distributed gently and widely.

Further, for example, in a stack 12 formed by stacking uncirculated banknotes such as brand-new banknotes, the banknotes (paper sheets) are stacked in firm contact with one another, and gaps do therefore not substantially exist between the banknotes. Therefore, there is a case that no distinctive peak in light intensity appears in light intensity distributions detected from a side surface of the stack 12.

Thus, the transmitted beam 38 emitted from a side surface of the stack 12 show light intensity distributions dependent on states of the paper sheets 10 forming the stack 12. Accordingly, the bundle-state detection apparatus 100 can detect a bundle state of the stack 12 by comparing and analyzing light intensity distributions detected at a plurality of regions on a side surface of the stack 12. The bundle state of the stack 12 relates to a contact state between the paper sheets 10 in the stack 12, and a mechanical characteristic (for example, rigidness) of the stacked paper sheets 10.

Rigidness (Young's modulus) of the paper sheets 10 greatly varies depending on materials, sizes, and thicknesses. Further, Young's modulus changes depending on environments (particularly humidity). In general, paper sheets 10 for post cards have a Young's modulus in a range of about 1 to 20 GPa. In contrast, Young's modulus of the paper sheets 10 for normal copy papers is within a range of about 1 to 3 GPa. Young's modulus of banknotes differs greatly depending on use states thereof. For example, brand-new banknotes have a high Young's modulus (also called to be rigid), and wrinkled or creased banknotes have a relatively-low Young's modulus (also called to be fragile). In the present description, fragile paper sheets 10 denote paper sheets 10 which have a Young's modulus not greater than about 1 GPa, as a reference.

Figure 9:
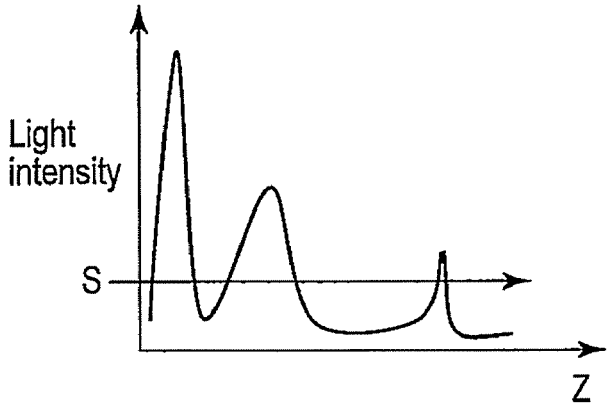
FIG. 9 is a view showing an example of a method for analyzing the light intensity distribution shown in FIG. 4.

FIG. 9 is an explanatory graph for explaining an example of a method for detecting a bundle state of a stack 12 from a light intensity distribution. In this detection method, a threshold S is preset in the information processing unit 30 for a detected light intensity. As shown in FIG. 9, the information processing unit 30 generates a brightness/darkness signal (1, 0) which indicates brightness (1) if a light intensity is not smaller than the threshold S or indicates darkness (0) if a light intensity is smaller than S. The information processing unit 30 calculates a width of the brightness (1) for each generated brightness/darkness signal. Next, the information processing unit 30 detects a bundle state by comparing widths of the brightness (1) calculated from brightness/darkness signals. Instead, a bundle state information table which describes a relationship between the light intensity distributions and the bundle states is prepared in the information processing unit 30. The information processing unit 30 may detect the bundle state of the stack 12 by referring to the bundle state information table, for the plurality of detected light intensity distributions.

As described above, in the bundle-state detection apparatus 100, an irradiation light beam is emitted toward a stack 12 in which a plurality of paper sheets 10 are stacked. Light intensity distributions of a transmitted light beam which emerges from a side surface of the stack 12 are detected by the plurality of light receivers 28A, 28B, and 28C. The information processing unit 30 can detect the bundle state of the stack 12, based on the detected light intensity distributions.

Next, a separation and extraction apparatus will be described, which separates and extracts the stacked paper sheets 10 one after another by utilizing the bundle-state detection apparatus 100 described above.

(Second Embodiment)

Figure 10:
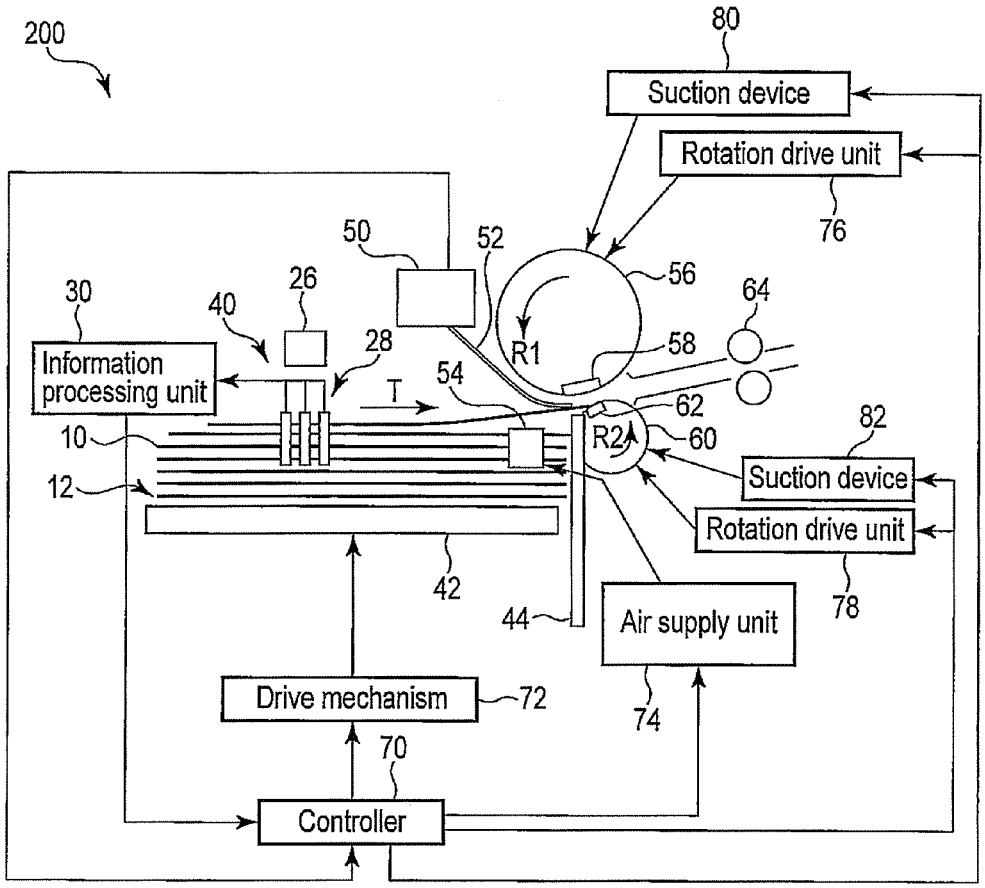
FIG. 10 is a block diagram showing a separation and extraction apparatus according to a second embodiment.

FIG. 10 shows a schematic configuration of a separation and extraction apparatus 200 according to a second embodiment. As shown in FIG. 10, the separation and extraction apparatus 200 comprises the support table 42 on which a stack 12 of paper sheets 10 is placed and supported. The support table 42 is driven by a drive mechanism 72 to move up or down along the stacking direction of stacking the paper sheets 10. The position of an uppermost surface of the stack 12 on the support table 42 is adjusted by the drive mechanism 72. The position of the uppermost surface of the stack 12 is detected by a position detection sensor, such as a lever-type sensor 50 having an arm 52 at a tip end thereof, or a contactless sensor. As the contactless sensor, it is possible to utilize an optical contactless displacement gauge. If the rotary lever-type sensor 50 is used as the position detection sensor, the arm 52 is brought into contact with the uppermost surface of the stack 12, and a rotary lever is thereby rotated. The position of the uppermost surface of the stack 12 is detected based on a rotation angle of the rotary lever. Uppermost surface position information indicating the position of the uppermost surface is transmitted from the position detection sensor 50 to a controller 70. The controller 70 adjusts the position of the uppermost surface of the stack 12 by controlling a drive mechanism 72, based on the uppermost surface position information.

Further, the separation and extraction apparatus 200 comprises a bundle state detector 40 (corresponding to the bundle-state detection apparatus 100 shown in FIG. 1). The bundle state detector 40 detects a bundle state of the stack 12, e.g., a contact state between paper sheets 10 positioned in an upper side of the stack 12. As described above, the bundle state detector 40 comprises: a light emitting unit 26 which is arranged above the stack 12 and emits a irradiation light beam onto an upper surface of the stack 12; a light receiving unit 28 including light receivers 28A, 28B, and 28C shown in FIG. 1 which detect light intensity distributions of a transmitted beam emitted from a side surface of the stack 12 and output detection signals; and an information processing unit 30 which detects a bundle state of the stack 12 based on the detection signals. Detection signals which are output from the light receivers 28A, 28B, and 28C respectively include light intensity distributions along the stacking direction on a side surface of the stack 12. Information indicating the bundle state detected by the information processing unit 30 is transmitted to the controller 70. The controller 70 controls operations of the drive mechanism 72, a feed roller 56, a separation unit 60, and an air supply mechanisms 54, depending on the detected bundle state.

The information processing unit 30 is illustrated to be separate from the controller 70 in FIG. 10, but may be realized as a part of the controller 70.

Above the stack 12, the feed roller 56 is provided as an extraction unit which extracts or picks up paper sheets 10 one after another from the upper surface of the stack 12 and conveys the paper sheets 10 sequentially. The separation unit (or separation roller) 60 is arranged opposite to the feed roller 56. A side of the separation unit 60 facing the paper sheets 10 is covered with a front guide 44 (corresponding to the side guide 22 shown in FIG. 1) so that the paper sheets 10 may not make direct contact with the separation unit 60. Further, the front guide 44 aligns the paper sheets 10 with one another, and supports a front surface of the stack 12, i.e., a side surface of the stack 12 where the paper sheets 10 are extracted.

The front guide 44 is arranged in a manner that an upper end thereof is apart from the feed roller 56 by a predetermined distance G. The upper end of the front guide 44 and the feed roller 56 define a guide port for guiding the paper sheets 10 to a conveyor path. Similarly, the feed roller 56 and separation unit 60 are arranged parallel to one another with a predetermined gap G maintained therebetween. The gap between the feed roller 56 and the separation unit 60 defines a conveyor path which communicates with the guide port. Therefore, conveyance of the paper sheets 10 is restricted by the upper end of the front guide 44, the feed roller 56, and the separation unit 60.

The feed roller 56 and the separation unit 60 are formed in substantially cylindrical shapes, and are respectively rotated by rotation drive units 76 and 78. The feed roller 56 is rotated as indicated by an arrow R1 to extract each paper sheet 10 and convey the paper sheet 10 in a conveying direction. The separation unit 60 is rotated in a direction opposite to rotation of the feed roller 56, as indicated by an arrow R2. The feed roller 56 and the separation unit 60 are respectively connected to suction devices 80 and 82 such as vacuum pumps or compressors. Suction units 58 and 62 to which flexible sheets such as rubber sheets are adhered are provided respectively on outer circumferences of the feed roller 56 and separation unit 60 or parts thereof. The suction units 58 and 62 respectively comprise negative pressure chambers (not shown) which communicate with the suction devices 80 and 82, and the negative pressure chambers are vacuumed (to a negative pressure) by the suction devices 80 and 82. As a result, the suction units 58 and 62 can suction a paper sheet 10.

Further, the separation and extraction apparatus 200 is provided with air supply mechanisms 54 which supply air to loose the paper sheets 10 which are stacked in contact with each other, that is, to make the paper sheets 10 separate from each other. The air supply mechanisms 54 are provided to oppose each other in two side surfaces of the stack 12. The air supply mechanisms 54 are not limited to the case of being provided in two side surfaces of the stack 12 but one air supply mechanism 54 may be provided in a side surface of the stack 12. Alternatively, an air supply mechanism 54 may be provided a below the stack 12 in front of the stack 12 in order to blow apart the paper sheets 10. Each of the air supply mechanisms 54 comprises an air blower port (not shown) which blows air in a direction substantially perpendicular to an extraction direction T. Air is blown out of the air blower port. A region to which air is blown includes a region near a tip end of the stack 12 in an upper side of the stack 12 and in a side where the paper sheets 10 are extracted. The air blown from the air supply mechanisms 54 is supplied at a timing when an upper surface of the stack 12 is located at a predetermined position as the support table 42 is moved up. When air is blown from the air supply mechanisms 54, the air enters between the paper sheets 10, and thus the paper sheets 10 in tight contact with one another are loosened. A front end of a paper sheet 10 on an uppermost surface of the stack 12 floats up. As a result, separation and extraction of the paper sheet 10 by the feed roller 56 are facilitated.

In an operation of extracting the paper sheets 10 one after another from the stack 12, at first, the feed roller 56 and separation unit 60 are driven to rotate, and the support table 42 is moved up to a position where a paper sheet 10 can be picked up from the stack 12. When the support table 42 is moved up, air is then supplied from the air supply unit 74. The supplied air is blown from the air supply mechanisms 54, and the paper sheets 10 are loosened. Subsequently, with the feed roller 56 and separation unit 60 being rotated stably, electromagnetic valves of the respectively corresponding suction devices 80 and 82 are opened, and a negative pressure is applied to inside thereof. When the feed roller 56 and separation unit 60 start suctioning, a front end of an uppermost paper sheet 10 of the stack 12 is suctioned by the suction unit 58 of the feed roller 56. The uppermost paper sheet 10 is extracted by friction of the rubber sheet, and is supplied to between the feed roller 56 and the separation unit 60. At this time, a successive paper sheet 10 extracted together with the uppermost paper sheet 10 of the stack 12 is suctioned by vacuum (negative pressure) by the suction unit 62 of the separation unit 60, and is returned to the support table 42 by friction of the rubber sheet on the surface of the suction unit 62. The paper sheet 10 extracted from the stack 12 is fed to a conveyor roller 64 by the feed roller, and is conveyed, by the conveyor 64, to a processor (not shown) which processes the paper sheet 10.

The feed roller 56 and separation unit 60 are not limited to an example which uses both of vacuum suction forces and frictions as shown in FIG. 10 but may be configured to use, for example, only friction. Although the suction devices 80 and 82 are illustrated as being configured to be separate from each other, the devices are not limited to this configuration but may be realized as a single suction device comprising a first electromagnetic valve for the feed roller 56 and a second electromagnetic valve for the separation unit 60.

In the separation and extraction apparatus 200 as an example of handling paper sheets 10, such as an automated teller machine (ATM), banknotes (or paper sheets) of various conditions are placed on the support table 42, including brand-new banknotes, circulated banknotes, creased banknotes, and wrinkled banknotes mixed together. A stack 12 in which paper sheets 10 are stacked in tight contact with one another, like a stack of stacked brand-new banknotes, air from the air supply mechanisms 54 hardly enters into between the paper sheets 10. Therefore, there is a risk that the paper sheets 10 are not loosened but a plurality of paper sheets 10 in tight contact with one other are extracted together. In this case, the air supply unit 74 is controlled to increase a flow rate and a pressure of air to be blown from the air blowing mechanisms 54, so that the paper sheets 10 in such a stack 12 can be loosened. Further, the suction device 82 is controlled to increase a suction force at the suction unit 62 in the separation unit 60 so that a paper sheet 10 which is extracted together with an uppermost paper sheet 10 is steadily separated. Thus, in the separation and extraction apparatus 200 shown in FIG. 10, a separation/extraction condition (simply referred to as an extraction condition) is set depending on a bundle state of the stack 12. The separation/extraction condition includes drive conditions for the air supply mechanisms 54, feed roller 56, separation unit 60, and support table 42. More specifically, drive conditions for the air supply mechanisms 54 include selection of the air supply mechanism 54 which blows air (when the air supply mechanisms 54 are provided in two sides of the stack 12), and a flow rate and a pressure of air which is blown from the air supply mechanisms 54. The drive conditions for the feed roller 56 include a flow rate and a pressure (i.e., a negative pressure) of air from the suction device 80. The drive conditions for the separation unit 60 include an air flow rate and a pressure (i.e., a negative pressure condition) from the suction device 82. In addition, the drive conditions for the support table 42 include an up elevation speed and an acceleration of the support table 42.

Figure 11:
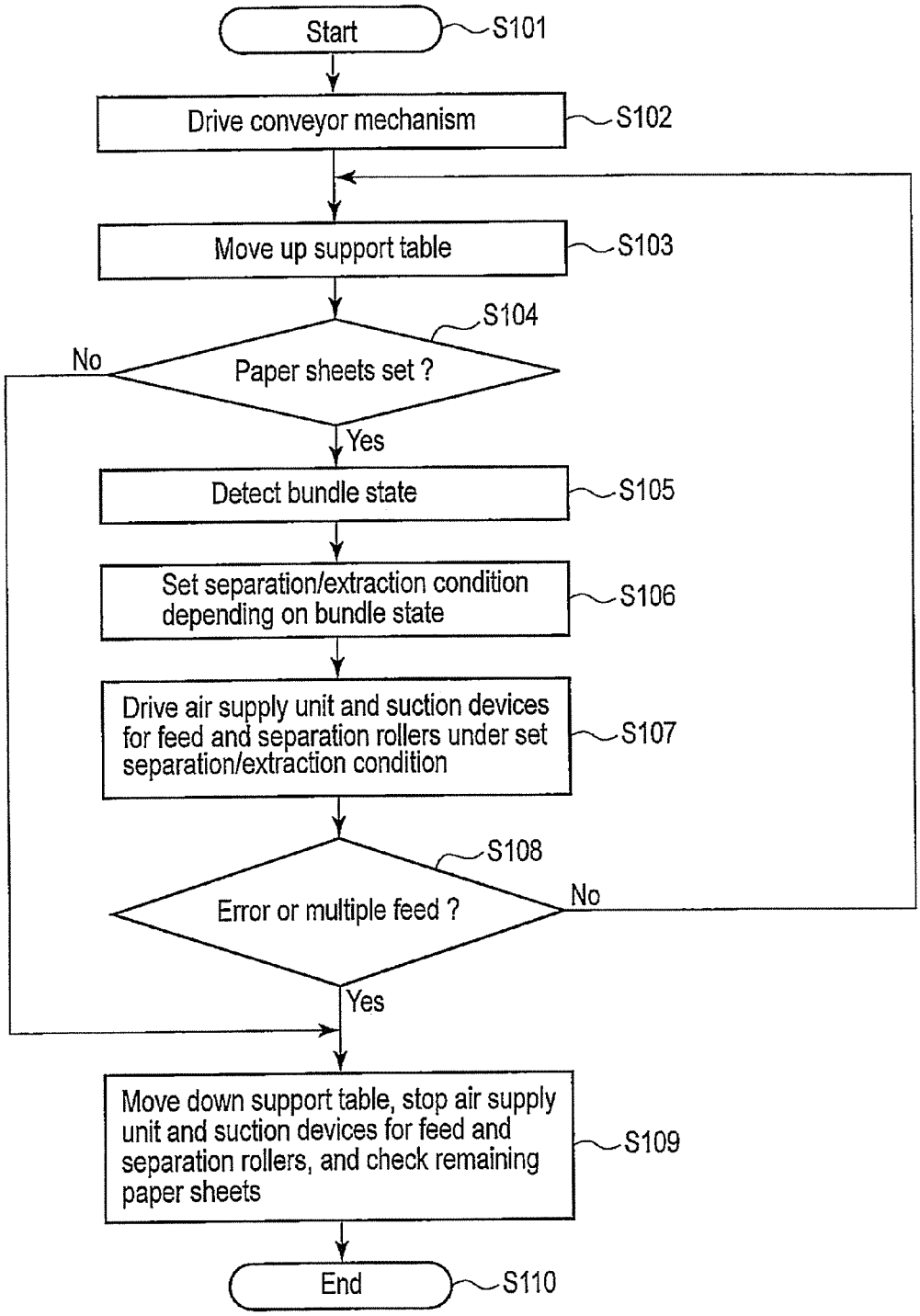
FIG. 11 is a flowchart showing an operation procedure of the separation and extraction apparatus shown in FIG. 10.

FIG. 11 schematically shows an operation procedure of the separation and extraction apparatus 200 incorporated in an apparatus such as an automated teller machine (ATM). At first, as shown in step S101 in FIG. 11, the separation and extraction apparatus 200 is started to operate. When the separation and extraction apparatus 200 is operated, the feed roller 56 and separation unit 60 are driven to rotate, in step S102. In step S103, the support table 42 on which the stack 12 is placed is moved up. In step S104, the controller 70 checks whether one or more paper sheets 10 are placed on the support table 42 or not. When the paper sheets 10 are placed on the support table 42, a bundle state of the stack 12 is detected in step S105. In step S106, the controller 70 sets a separation/extraction condition depending on the detected bundle state.

In step S107, the air supply unit 74, the suction device 80 for the feed roller 56, and the suction device 82 for the separation roller 60 are driven under the set separation/extraction condition, thereby starting a separation/extraction operation. When the separation/extraction operation is started, whether an extraction error in extracting a paper sheet 10 or a multiple feed occurs or not is detected, as shown in step S107, by a monitor sensor (not shown in FIG. 11) provided on the conveyor path. In step S107, if neither an extraction error nor a multiple feed is confirmed to be occurring, the operation procedure is then returned to step S103, and a successive paper sheets 10 is extracted from the stack 12. In a process in which the support table 42 shown in step S103 is moved up, a lift speed of the support table 42 is controlled in accordance with the separation/extraction condition set in step S106.

If no paper sheet 10 is confirmed to be placed in step S104 or if an extraction error or a multiple feed occurs in step S108, the support table 42 is moved down as shown in step S109. Then, the air supply unit 74, the suction device 80 for the feed roller 56, and the suction device 82 for the separation unit 60 are stopped. Paper sheets 10 remaining on the support table 42 are checked. In step S110, the operation procedure of the separation and extraction apparatus 200 ends.

As described above, the separation and extraction apparatus 200 comprising the bundle state detector 40 detects a bundle state of the stack 12. An optimal separation/extraction condition is set depending on the detected bundle state. Accordingly, paper sheets 10 can be separated and extracted one after another even from a stack 12 in which various paper sheets 10 are stacked.

Paper sheets 10 are not limited to the example as shown in FIG. 10 in which the paper sheets 10 are stacked in the direction of gravitational force but may be stacked along a direction perpendicular to the direction of gravitational force, i.e., horizontally. If the paper sheets 10 are stacked horizontally, upper and lower surfaces of the stack 12 are arranged to oppose each other along the horizontal direction (stacking direction). Accordingly, in the present specification, upper and lower surfaces of the stack 12 are defined in relation to the stacking direction, as a reference, and surfaces extending along the stacking direction are called side surfaces.

The support table 42 is not limited to the case in which the upper surface thereof is kept horizontal. However, the support table 42 may be provided to be inclined to a pickup direction T.

(Third Embodiment)

Figure 12:
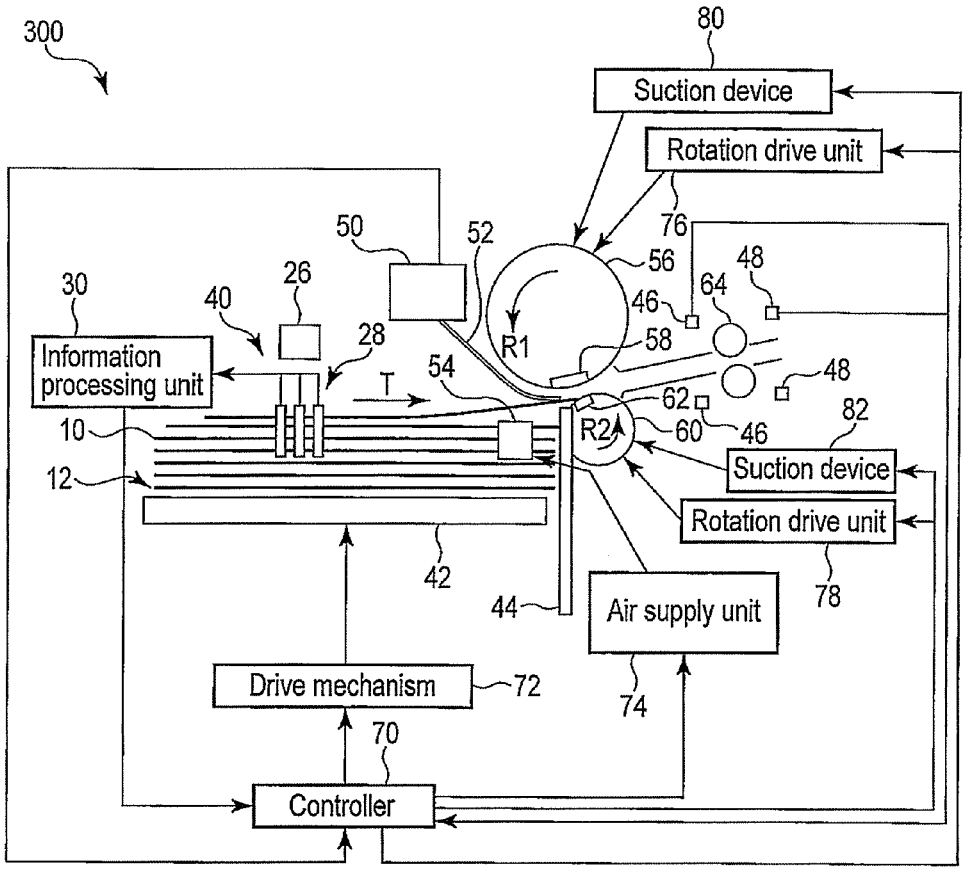
FIG. 12 is a block diagram showing a separation and extraction apparatus according to a third embodiment.

FIG. 12 shows a schematic configuration of a separation and extraction apparatus 300 according to a third embodiment. In the separation and extraction apparatus 300 according to the third embodiment, a separation/extraction condition is set depending on a bundle state of the stack 12, as in the separation and extraction apparatus 200 according to the second embodiment. However, extraction performance or, namely, a conveyance state of paper sheets 10 is evaluated by a first monitor sensor 46 and a second monitor sensor 48 provided on the conveyor path, and a separation/extraction condition is changed depending on the evaluated extraction performance.

Figure 13A:
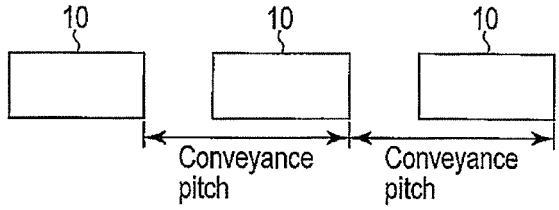
FIG. 13A is a view showing a conveyance pitch.

On the conveyor path of the separation and extraction apparatus shown in FIG. 12, there are provided the first monitor sensor 46 which measures a conveyance pitch (also referred to as a sheet pitch) of paper sheets 10 being conveyed, and the second monitor sensor 48 which detects thicknesses of paper sheets 10 being conveyed. As shown in FIG. 13A, the conveyance pitch denotes a time from when a front end of a paper sheet 10 passes to when a front end of a next paper sheet 10 passes. In FIG. 13A and following FIGS. 13B to 13E, paper sheets 10 are illustrated to be conveyed in longitudinally. When the conveyance pitch varies a little, the conveyance pitch implies that an extraction operation for paper sheets 10 is performed stably. When the conveyance pitch varies greatly or causes a disturbance, the conveyance pitch implies that a multiple feed or a failure occurs.

Figure 13B:
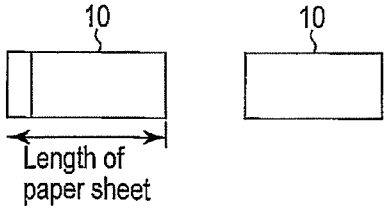
FIG. 13B is a view showing an example of a conveyance state of paper sheets to be rejected.
Figure 13C:
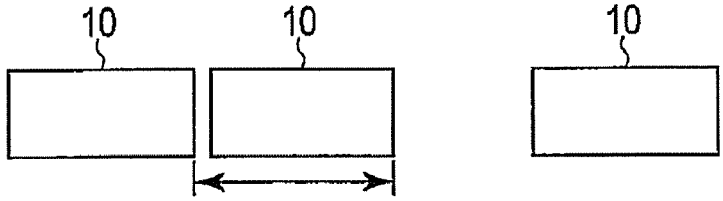
FIG. 13C is a view showing another example of a conveyance state of paper sheets to be rejected.
Figure 13D:
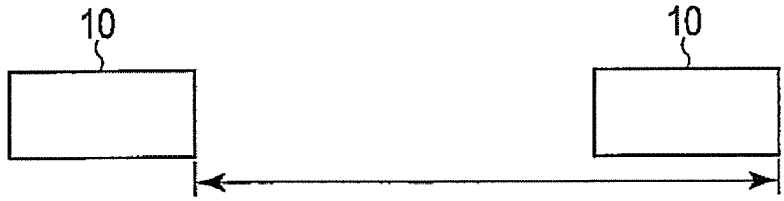
FIG. 13D is a view showing an example of a conveyance state causing an extraction error.

As the first monitor sensor 46, for example, it is possible to utilize a light shielding sensor in which a light emitting element and a light receiving element are opposed to each other over the conveyor path inserted therebetween. In this example, the first monitor sensor 46 is configured to output a darkness signal when an infrared beam irradiated from the light emitting element is shielded by a paper sheet 10 being conveyed and is therefore not detected by the light receiving element. In the other cases, a brightness signal is output. Accordingly, the first monitor sensor 46 can detect front and rear ends of the paper sheet 10 being conveyed, and can measure a conveyance pitch and a length of the paper sheet 10 being conveyed. As shown in FIG. 13B, if the length of the paper sheet 10 measured by the first monitor sensor 46 is greater than a length of the paper sheet 10 per sheet, a controller 70 determines that a multiple feed occurs. If a multiple feed occurs, corresponding paper sheets 10 are rejected, conveyed to a storage box (not shown), and stored into the storage box. Further, as shown in FIG. 13C, the conveyance pitch is short in relation to a length of the paper sheets 10, i.e., if an interval between a rear end of a paper sheet 10 and a front end of a next paper sheet 10 is narrow, these paper sheets 10 are rejected as an extraction error. Further, as shown in FIG. 13D, if the conveyance pitch is too long, an adjustment error or jamming at a pickup unit is determined to be occurring. The separation and extraction apparatus 200 is then stopped as causing an error.

Conveyance pitch information indicating the conveyance pitch detected by the first monitor sensor 46 is transmitted to the controller 70. The controller 70 evaluates extraction performance based on the received conveyance pitch information. As an example of a method for evaluating extraction performance, the controller 70 calculates a standard deviation a of the conveyance pitch based on the conveyance pitch information, and compares the standard deviation a with preset two reference values K1 and K2 (where, K1<K2), to evaluate the conveyance performance. In this evaluation method, the controller 70 determines the conveyance performance to be excellent if $\sigma \leqq K1$. The conveyance performance is determined to be acceptable (within an allowable range) if $K1<\sigma<K2$. The conveyance performance is determined to be unacceptable (defective) if $K2 \leqq \sigma$. The controller 70 adjusts the separation/extraction condition in order to maintain a constant conveyance pitch, based on the evaluated conveyance performance.

Figure 13E:
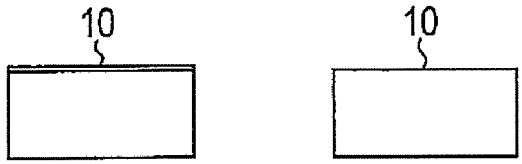
FIG. 13E is a view showing another example of a conveyance state of paper sheets to be rejected.

The second monitor sensor 48 can detect whether a paper sheet 10 or a plurality of paper sheets 10 are conveyed, by detecting thicknesses of paper sheets 10. As shown in FIG. 13E, when the second monitor sensor 48 detects a plurality of paper sheets 10 as being conveyed overlapped on one another, these paper sheets 10 are rejected and stored into the storage box, and the apparatus 200 is stopped. From the second monitor sensor 48, information including the number of multiply fed sheets and the number of rejected sheets is transmitted to the controller 70.

Figure 14:
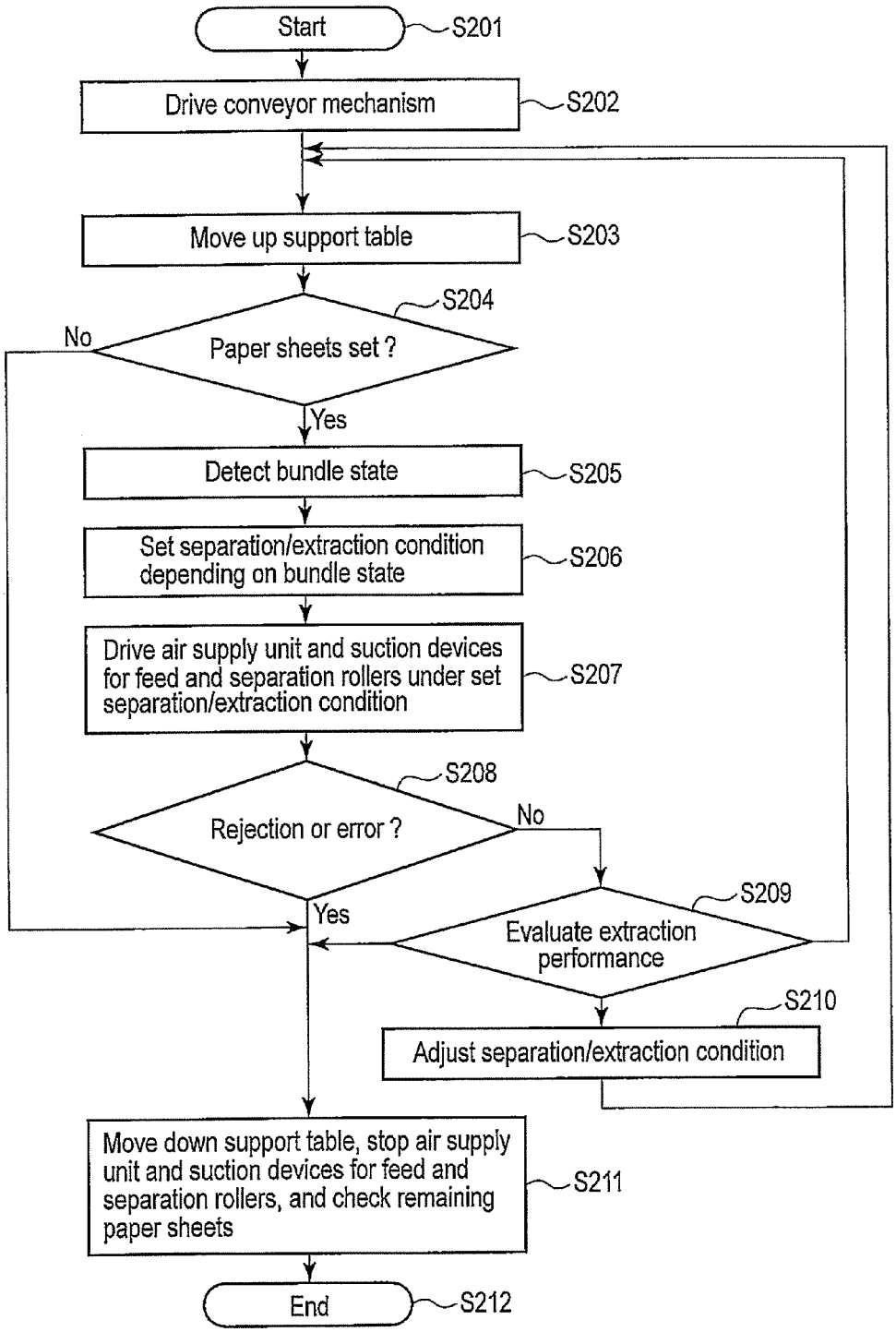
FIG. 14 is a flowchart showing an operation procedure of the separation and extraction apparatus shown in FIG. 12.

FIG. 14 schematically shows an operation of the separation and extraction apparatus 300 shown in FIG. 12. Steps S201 to S207 shown in FIG. 14 are the same as steps S101 to S107 described above with reference to FIG. 11, and descriptions thereof will be therefore omitted.

Between steps S201 and S207 shown in FIG. 14, a bundle state of a stack 12 is detected, and a feed roller 56 and a separation unit 60 are driven depending on the detected bundle state. An extraction operation for paper sheets 10 is then started. The controller 70 checks whether or not an error or a rejection has occurred during the extraction operation, as shown in step S208 in FIG. 14. If neither an error nor rejection is confirmed to have occurred, extraction performance (a conveyance state of a paper sheet 10) is evaluated in step S209. Specifically, the extraction performance is determined to be excellent, acceptable, or unacceptable. If the conveyance performance is determined to be excellent in step S209, the procedure is returned to step S203, and the extraction operation for paper sheets 10 is continued. If extraction performance is determined to be acceptable in step S209, the separation/extraction condition is adjusted in accordance with the extraction performance, in step S210. The operation procedure is returned to step S203. If extraction performance is determined to be unacceptable (i.e., defective), the operation procedure goes to step S211. Similarly, if an extraction error or a rejection is confirmed in step S208, the operation procedure also goes to step S211. In step S211, the support table 42 is moved down, and the air supply unit 54, and suction devices 80 and 82 for the feed roller 56 and the separation unit 60 are stopped. Further, paper sheets 10 remaining on the support table 42 are confirmed. In step S212, the operation procedure of the separation and extraction apparatus 300 ends.

As described above, in the separation and extraction apparatus 300 shown in FIG. 12, the separation/extraction condition is set depending on a bundle state of a stack 12, and is adjusted depending on the extraction performance. Hence, paper sheets 10 can be separated and extracted one after another more stably.

(fourth embodiment)

Figure 15:
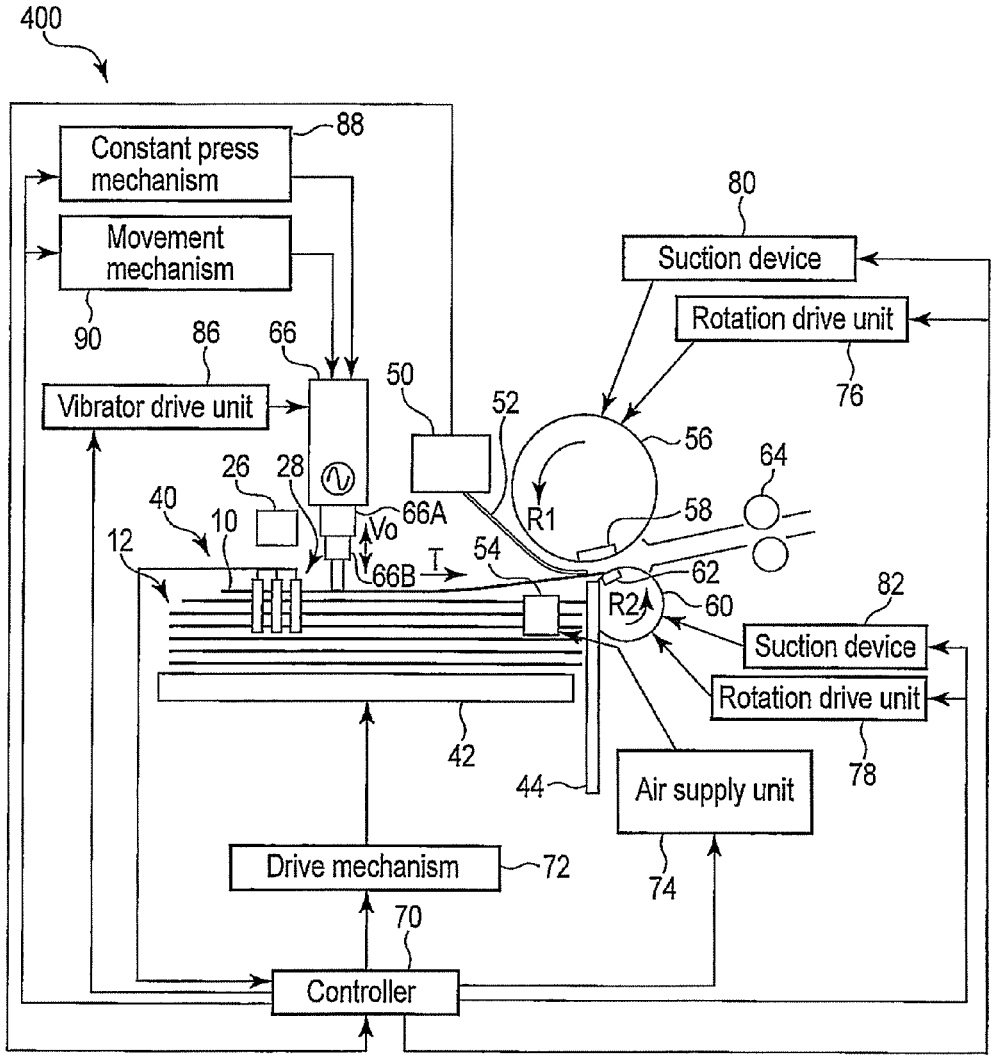
FIG. 15 is a block diagram showing a separation and extraction apparatus according to a fourth embodiment.

FIG. 15 shows a schematic configuration of a separation and extraction apparatus according to a fourth embodiment. Compared with the apparatus shown in FIG. 10, the separation and extraction apparatus 400 shown in FIG. 15 is further provided with a vibration unit 66 which is brought into contact with a stack 12 and vibrates paper sheets 10 which tend to easily make tight contact with one another. The controller 70 shown in FIG. 15 comprises an information processing unit 30 shown in FIG. 10, and can detect a bundle state of the stack 12 by processing light intensity distribution information from the light receivers 28.

Figure 16A:
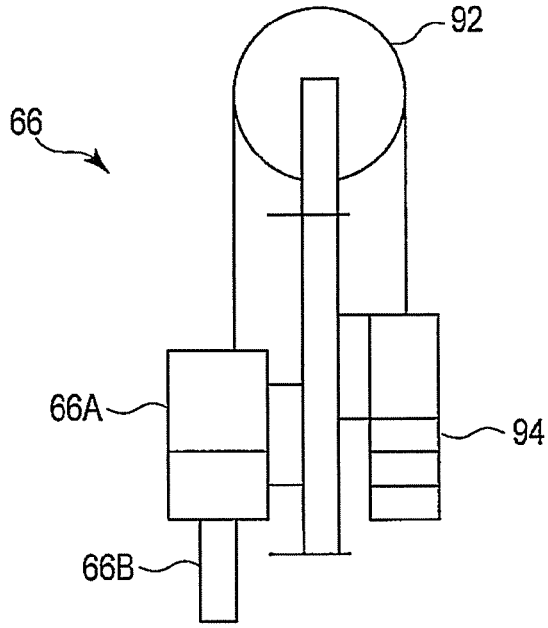
FIG. 16A is a side view showing an example of a press mechanism for a vibration unit shown in FIG. 15.
Figure 16B:
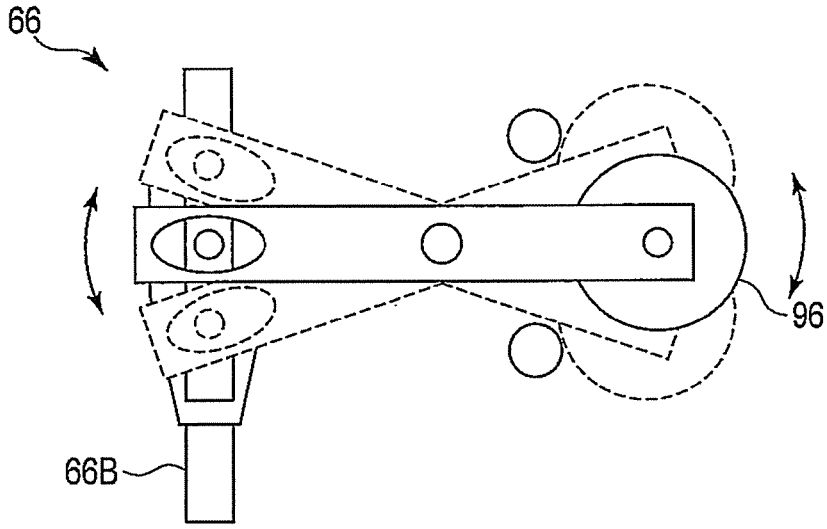
FIG. 16B is a side view showing another example of the press mechanism for the vibration unit shown in FIG. 15.

The vibration unit 66 is arranged so as to make spot-like contact with an upper surface of the stack 12, and can apply an ultrasonic vibration VO to the stack 12. The vibration unit 66 is connected to a constant press mechanism 88 which presses the vibration unit 66 to the stack 12. A press force applied to the stack 12 from the vibration unit 66 is kept constant by the constant press mechanism 88. With the press force kept constant, an ultrasonic vibration is applied from the vibration unit 66 to the stack 12 by the constant press mechanism 88 in a direction substantially perpendicular to the upper surface of the stack 12. The constant press mechanism 88 needs to be a mechanism capable of applying a constant load in a certain stroke, in accordance with a height of the stack 12. If a press load of the vibration unit 66 is great, the press load becomes resistance at the time of extraction. If the press load is small, a friction reduction effect between paper sheets 10 decreases. Therefore, for example, a press mechanism of a counter weight type which is equipped with a pulley 92, as shown in FIG. 16A, or a press mechanism of a seesaw type in which a dead weight of the vibration unit 66 is partially cancelled by a weight 96 is used.

The vibration unit 66 is not limited to the case shown in FIG. 15 in which the vibration unit 66 is pressed into contact with the upper surface of the stack 12 with a constant press force but may alternatively be configured to comprise a press force adjust mechanism which adjusts the press force to press the vibration unit 66 to the stack 12, and to change the press force applied from the vibration unit 66 to the stack 12, depending on a bundle state of the stack 12.

Further, the vibration unit 66 shown in FIG. 15 is connected to a movement mechanism 90. This movement mechanism 90 retracts the vibration unit 66 from the stack 12 or brings the vibration unit 66 into contact with the stack 12. Used as this movement mechanism 90 is a mechanism which attracts or releases the vibration unit 66 by an electromagnet with use of a solenoid or a mechanism which moves the vibration unit 66 up and down with a motor.

In the embodiment, the vibration unit 66 has a structure in which a vibrator 66A is connected to an ultrasonic horn 66B. The vibrator 66A is a so-called bolt-clamped transducer, and has a structure in which an electrode is extended from inside of a piezoelectric ceramic part corresponding to a piezoelectric element and this piezoelectric ceramic part is tightened by a bolt between a pair of round columnar blocks. In the vibration unit 66, the ultrasonic horn 66B is screwed on the round columnar blocks, and the ultrasonic horn 66B is fixed to the vibrator 66A. In the vibrator 66A, when a disc-type piezoelectric ceramic part is ultrasonically vibrated depending on a drive voltage applied to the electrode, the whole vibration unit 66 then vibrates, and vibration thereof is transmitted to a vibration surface of the round columnar blocks. The piezoelectric ceramic part has a relatively small amplitude so that there is a risk as follows. Even if ultrasonic vibration is extracted from a vibration surface of the round columnar blocks and is applied to a surface of the stack 12, vibration which is enough to sufficiently loosen the paper sheets 10 may not be applied to the stack 12. Therefore, in order to amplify the ultrasonic vibration, the vibrator 66A is mechanically connected to the ultrasonic horn 66B. The vibrator 66A is driven to vibrate by a drive signal from the vibrator drive unit 86.

The vibration unit 66 comprising such an ultrasonic horn 66B as described above has a tip end which is vibrated in a direction substantially perpendicular to the surface of the stack 12. When the ultrasonic horn 66B is pressed to the upper surface of the stack 12, friction between a tip end of the ultrasonic horn 66B and an uppermost paper sheet 10 and friction between the uppermost paper sheet 10 and a paper sheet 10 stacked thereunder both become sufficiently low. By conveying the uppermost paper sheet 10 in this state, separation can be achieved with less multiple feed. A frequency of an ultrasonic wave which achieves effective separation is set at a frequency above an audible range, e.g., a frequency from 18 to 28 kHz.

The separation and extraction apparatus 400 shown in FIG. 15 comprises the air supply mechanism 54 which blows air toward a side surface of a stack 12. When a paper sheet 10 is separated and extracted, a loosening method using air and a loosening method using ultrasonic vibration are used together to loosen the paper sheets 10 in the stack 12. As described above, the separation and extraction apparatus 400 can reduce a force of tight contact between paper sheets 10 by making spot-like contact with and by vibrating an uppermost paper sheet 10 of the stack 12. The separation and extraction apparatus 400 can effectively loosen the paper sheets 10 by being supplied with air from the air supply mechanism 54 with the tight contact force reduced between the paper sheets 10 by ultrasonic vibration.

The present inventors have experimentally verified effectiveness of the loosening method by ultrasonic vibration for various stacks 12. As a result of this experiment, the loosening method using ultrasonic vibration was confirmed to be highly effective for a stack 12 which is formed by highly rigid paper sheets (e.g., brand-new banknotes) 10. With respect to a stack 12 formed by various paper sheets 10 having different friction coefficients, it was also confirmed that differences between initial friction coefficients are relaxed by reducing friction forces between paper sheets and stable separation and extraction can be achieved. However, less rigid paper sheets (e.g., fragile paper sheets) 10 were also confirmed to tend to reduce a friction reduction effect.

Based on this experimental result, the separation and extraction apparatus 400 carries out separation and extraction by using either or both of the loosening method using ultrasonic vibration and the loosening method using air, depending on a bundle state of paper sheets 12 detected by the bundle state detector 40. More specifically, both of the loosening methods using ultrasonic vibration and air are used for a stack 12 such as a bundle of brand-new banknotes. The loosening method using air is used for a stack 12 such as a bundle of creased or wrinkled paper sheets 10 (e.g., less rigid paper sheets) 10. When only the air loosening method is used, the vibration unit 66 is retracted from the stack 12 by the movement mechanism 90. Accordingly, the separation and extraction apparatus 400 loosens paper sheets 10, independently from states of stacked paper sheets 10, and paper sheets 10 can be separated and extracted more stably. Further, use of the vibration unit 66 is limited to a specific bundle state, and therefore, a lifetime of the vibration unit 66 can be extended.

In the separation and extraction apparatus 400 shown in FIG. 15, a condition database may be prepared which describes optimal separation/extraction conditions for respective bundle states. In this case, the separation/extraction condition is determined by referring to the condition database with respect to a detected bundle state. Further, a system such as a neural network may be incorporated in the separation and extraction apparatus 400, and the optimal separation/extraction condition may be determined from experimental values.

Figure 17:
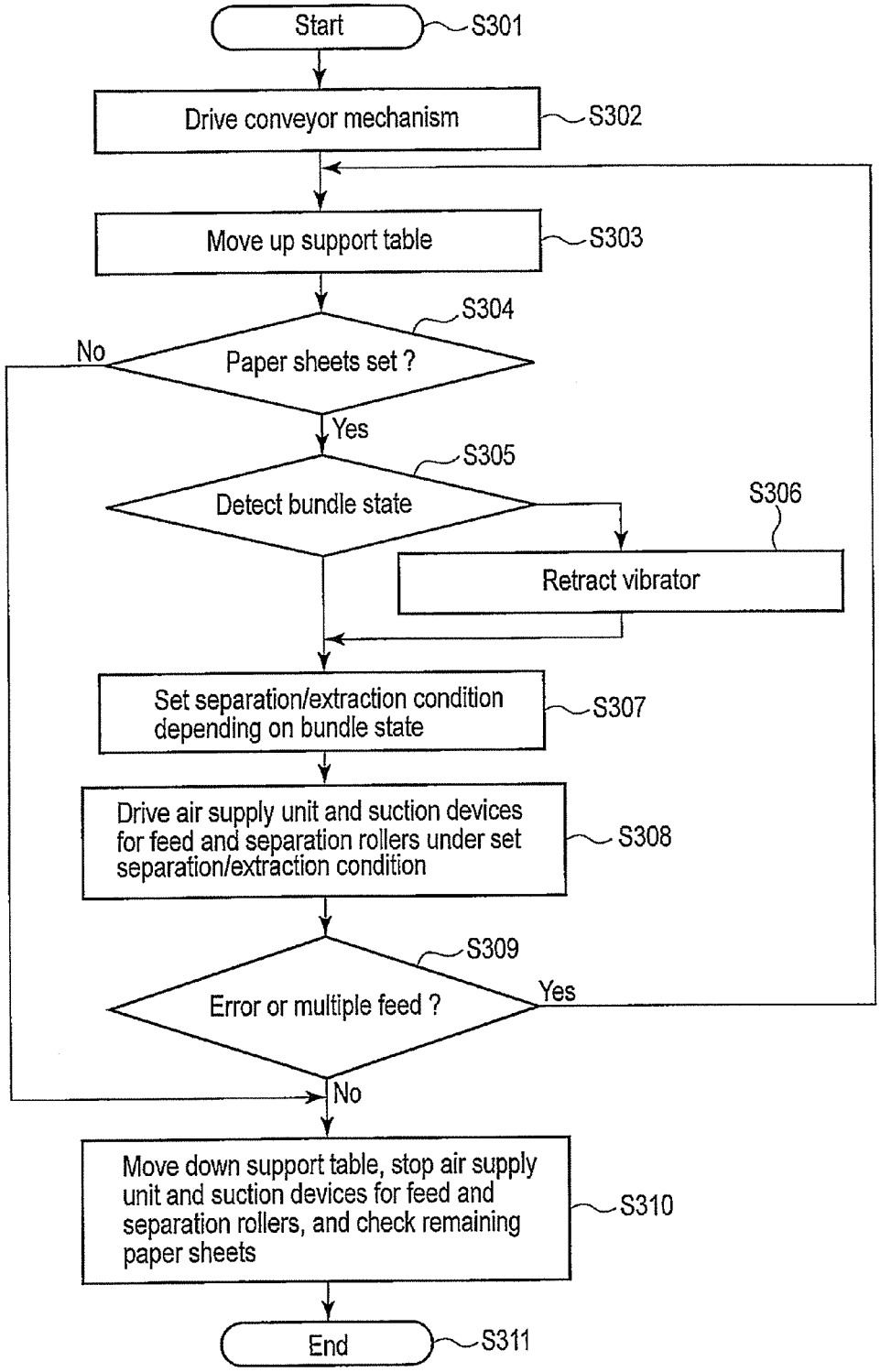
FIG. 17 is a flowchart showing an operation procedure of the separation and extraction apparatus shown in FIG. 15.

FIG. 17 schematically shows an operation of the separation and extraction apparatus 400 shown in FIG. 15. Steps S301 to S304 shown in FIG. 17 are the same as steps S101 to S104 in FIG. 11, and descriptions thereof will be therefore omitted. A conveyor mechanism including the feed roller 56, separation unit 60, and conveyor roller 64 is driven, and the support table 42 is lifted. Thereafter, in step S305 in FIG. 17, a bundle state of a stack 12 is detected. If the stack 12 is determined to be a bundle of fragile paper sheets or, namely, wrinkled or creased paper sheets 10 in step S305, as shown in step S305, the vibration unit 66 in contact with the upper surface of the stack 12 is retracted, as shown in step S306. In step S305, if the stack 12 is determined to be a bundle of highly rigid paper sheets 10 or flat paper sheets 10, the vibration unit 66 and the upper surface of the stack 12 are kept in contact with each other. Next, the controller 70 sets a separation/extraction condition depending on a detected bundle state, in step S307. In step S308, the air supply unit 74, the suction device 80 for the feed roller 56, the suction device 82 for the separation unit 60, and the vibration unit 66 are driven under the set separation/extraction condition, and an extraction operation for paper sheets 10 is thereby started. When the extraction operation is started, whether an extraction error or a multiple feed has occurred or not is then detected, in step S309. If occurrence of neither an extraction error nor a multiple feed is confirmed in step S309, an operation procedure is then returned to step S303, and a successive paper sheet 10 is extracted.

If it is confirmed in step S304 that no paper sheet 10 is placed on the support table 42 or in step S309 that an extraction error or a multiple feed of paper sheets 10 has occurred, the support table 42 is moved down and the air supply mechanisms 54, feed roller 56, separation unit 60, and vibration unit 66 are stopped, as shown in step S310. In step S311, the operation procedure of the separation and extraction apparatus 400 ends.

As has been described above, the separation and extraction apparatus 400 according to the fourth embodiment, the paper sheets 10 are loosened by using air from the air supply mechanisms 54 and by using high-frequency vibration of the vibration unit 66. With contact forces reduced between the paper sheets 10, the paper sheets 10 are extracted one after another from the upper surface of the stack 12, and a more stable extraction operation is achieved.

(Fifth Embodiment)

Figure 18:
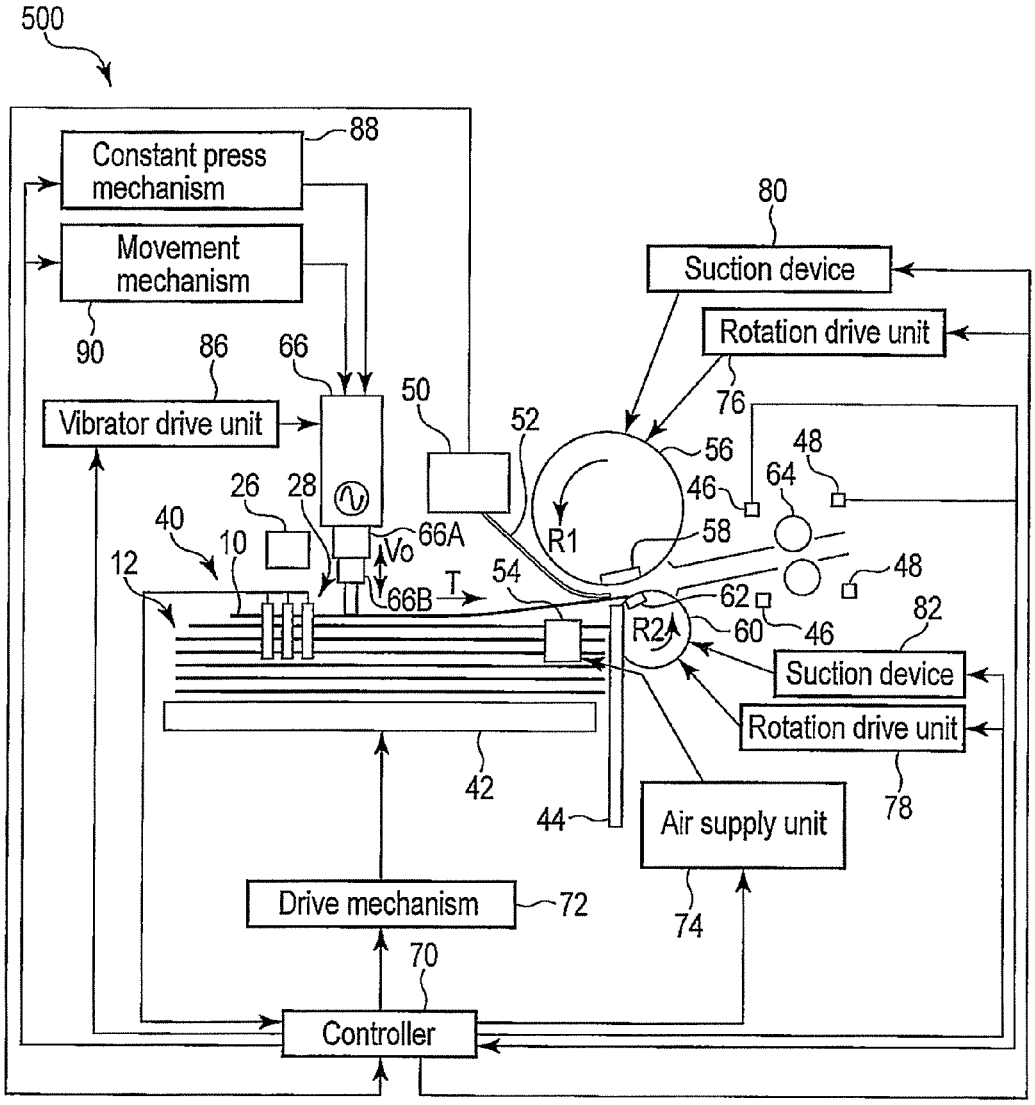
FIG. 18 is a block diagram showing the separation and extraction apparatus according to a fifth embodiment.

FIG. 18 shows a schematic configuration of a separation and extraction apparatus 500 according to a fifth embodiment. The separation and extraction apparatus 500 shown in FIG. 18 comprises the vibration unit 66 which vibrates a stack 12, and the air supply mechanisms 54 which supply air to a side surface of the stack 12, like the separation and extraction apparatus 400 shown in FIG. 15. A bundle state of the stack 12 placed on a support table 42 is detected by a bundle state detector 40. These vibration unit 66 and air supply mechanisms 42 are controlled by a controller 70, depending on the bundle state. Also depending on the detected bundle state of the stack 12, the feed roller 56 and the separation unit 60 are controlled. Further, conveyance pitch information, multiple feed information, and rejection information are supplied to the controller 70 from the first and second monitor sensors 46 and 48 provided on the conveyor path. Depending on the information described above, a separation/extraction condition including drive conditions for the vibration unit 66, air supply mechanisms 42, support table 42, feed roller 56, and separation unit 60 are adjusted.

Figure 19:
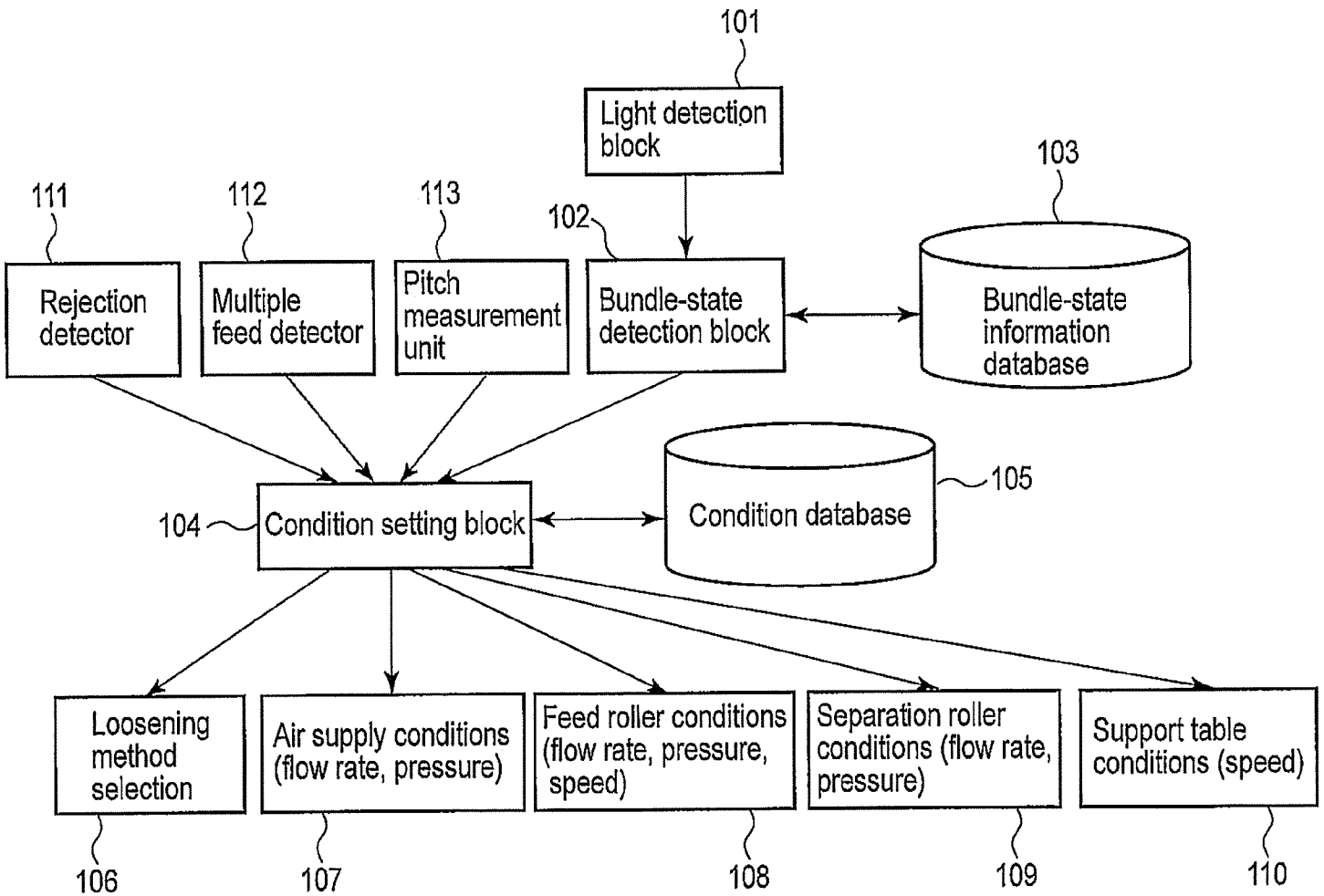
FIG. 19 is a block diagram showing for explaining a procedure for setting a separation/extraction condition in the separation and extraction apparatus shown in FIG. 18.

FIG. 19 schematically shows a method for setting the separation/extraction condition. As shown in FIG. 19, a light detection block 101 detects a transmitted beam emerging from a side surface of the stack 12, and output a detection signal to a bundle state detection block 102. The bundle state detection block 102 detects a light intensity distribution along a stacking direction on the side surface of the stack 12 from the detection signal, and detects or determines a bundle state of the stack by referring to a bundle state information database 103 based on a detected light intensity distribution. The bundle state information database 103 prescribes relationships between light intensity distributions and bundle states. Bundle state information indicating the bundle state determined by the bundle state detection block 102 is transmitted to a condition setting block 104. The condition setting block 104 refers to a condition database 105, which prescribes optimal separation/extraction conditions for respective bundle states, with respect to the received bundle state information, and sets the separation/extraction condition. The separation/extraction condition include: a loosening method selection (for example, a selection concerning either a loosening method using ultrasonic vibration or a loosening method using air is used or both of the methods are used) 106; air supply conditions 107 including a flow rate and a pressure of air supplied from the air supply mechanisms 54; drive conditions 108 for the feed roller 56, including a conveyance speed for conveying paper sheets 10, and a flow rate and a pressure of air; and drive conditions 110 for the support table 42, including a lift speed of the support table 42.

Conveyance state information concerning a conveyance state is input to a condition setting block 105 from a rejection detector 111 which detects that any paper sheet 10 being conveyed is rejected by an operation error, a multiple feed detector 112 which detects a multiple feed, and a pitch measurement unit 113 which measures a conveyance pitch. Based on the input conveyance state information, separation/extraction condition is adjusted by the condition setting block 105.

Figure 20:
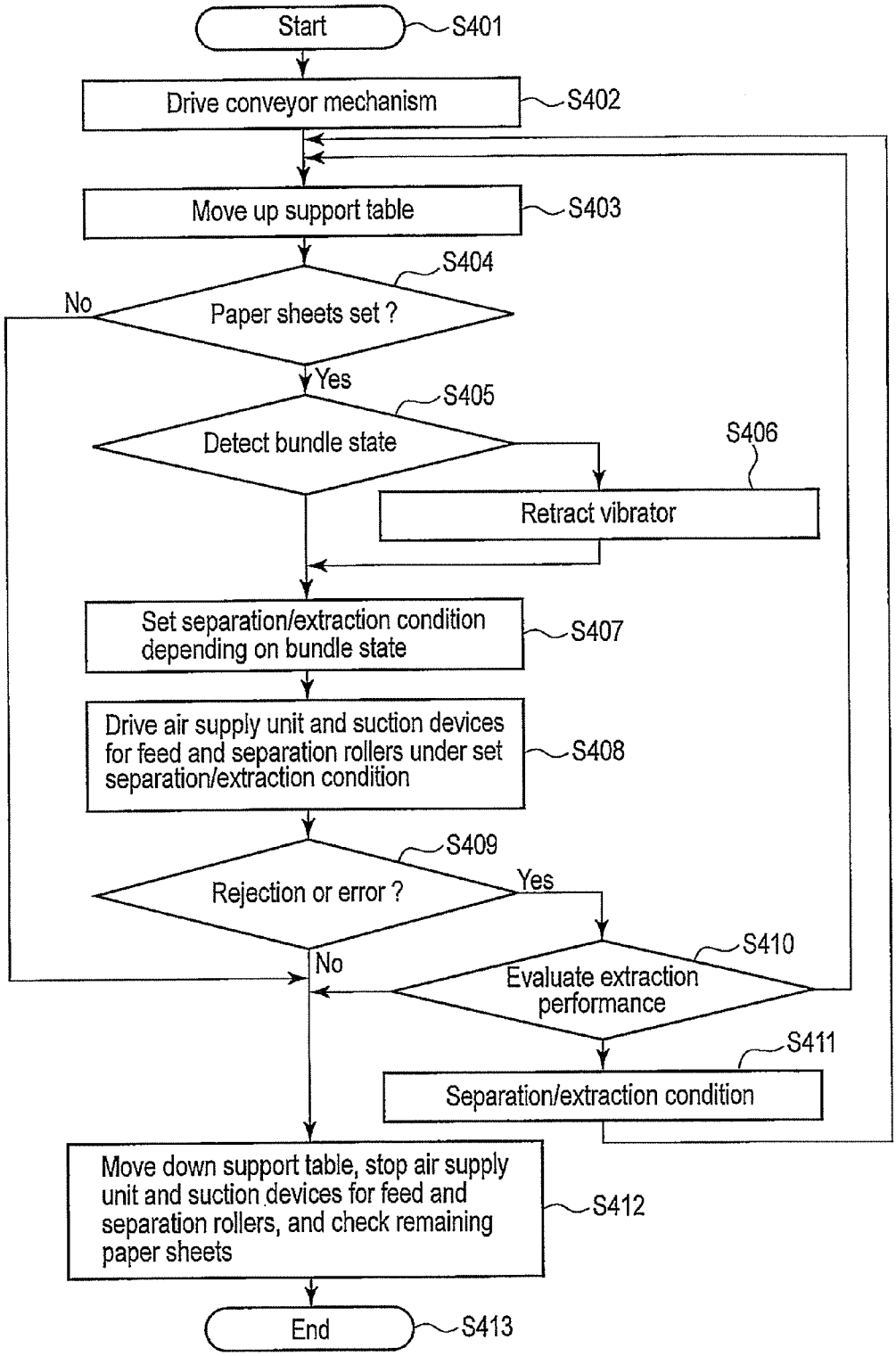
FIG. 20 is a flowchart showing an operation procedure of the separation and extraction apparatus shown in FIG. 18.

FIG. 20 schematically shows an operation procedure of the separation and extraction apparatus 500 shown in FIG. 18. Steps S401 to S409 and steps S412 and S413 which are shown in FIG. 18 are the same as steps S301 to S309 and steps S310 and S311 which are shown in FIG. 17. Specifically, the operation procedure shown in FIG. 20 differs from the operation procedure shown in FIG. 17 when neither an extraction error nor a rejection occurs.

In steps S401 to S408, a bundle state of the stack 12 placed on the support table 42 is detected, the support table 42, vibration unit 66, air supply mechanisms 54, feed roller, and separation roller are driven depending on the detected bundle state, and an extraction operation for paper sheets 10 is started. If it is confirmed in step S409 that neither an extraction error nor a rejection occurs, extraction performance is evaluated in step S410. If the extraction performance is determined to be excellent in step S410, the procedure is returned to step S403, and extraction of the paper sheets 10 is continued. If the extraction performance is determined to be acceptable in step S410, the procedure goes to step S411. In step S411, the separation/extraction condition is adjusted. The procedure is then returned to step S403. If the extraction performance is determined to be unacceptable, the procedure goes to step S412. In step S412, the support table 42, vibration unit 66, air supply mechanisms 54, feed roller, and separation roller are stopped. In step S413, the operation procedure of the separation and extraction apparatus 500 ends.

As has been described above, the separation and extraction apparatus 500 according to the fifth embodiment uses a loosening method using air blowing and high-frequency vibration. Depending on a bundle state and extraction performance of the stack 12, the separation/extraction condition is set. Without depending on the bundle state of the stack 12, paper sheets 10 can be separated and extracted more stably from the stack 12.

The separation and extraction apparatus according to at least one of the embodiments can precisely extract one paper sheet after another from a stack in which various paper sheets are stacked on one another.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A separation and extraction apparatus comprising:

a support unit configured to support a stack of paper sheets stacked in a stacking direction, the stack having an upper surface, a lower surface, and a plurality of side surfaces extending in the stacking direction;

an extraction unit configured to extract one or more paper sheets from the stack and convey the one or more paper sheets;

a separation unit configured to separate one paper sheet from the other paper sheet or paper sheets of the one or more paper sheets;

an air supply mechanism configured to supply air toward a first surface selected from the side surfaces;

a detector configured to detect a bundle state of the stack, the bundle state being related to a contact state between the paper sheets; and a controller configured to set an extraction condition depending on the bundle state, the extraction condition including a drive condition for the extraction unit, a drive condition for the separation unit, and a drive condition for the air supply mechanism.

2. The apparatus according to claim 1, wherein the detector comprising:

a light emitting unit configured to emit a light beam toward a second surface selected from the upper surface and the lower surface;

a light receiving unit arranged opposite to a third surface selected from the side surfaces, and configured to detect light intensity distributions of transmitted beams emerging from a plurality of regions on the third surface to generate a plurality of detection signals, the transmitted beams being generated by the light beam which passes through the stack; and a processing unit configured to process the detection signals to detect the bundle state.

3. The apparatus according to claim 2, further comprising:

a vibration unit configured to make contact with the upper surface and apply high-frequency vibration to the stack; and a movement mechanism configured to retract the vibration unit from the stack or bring the vibration unit into contact with the stack depending on the bundle state, wherein the extraction condition further includes a drive condition for the vibration unit.

4. The apparatus according to claim 3, further comprising a monitor sensor configured to detect a conveyance state of the separated paper sheet, wherein the controller sets the extraction condition depending on the bundle state and the conveyance state.

5. The apparatus according to claim 1, wherein the detector comprising:

a light emitting unit configured to emit a light beam toward a second surface selected from the upper surface, the lower surface, and the side surfaces;

a light receiving unit arranged opposite to a third surface selected from the side surfaces, and configured to detect light intensity distributions of transmitted beams emerging from a plurality of regions on the third surface to generate a plurality of detection signals r the transmitted beams being generated by the light beam which passes through the stack, the third surface being different from the second surface; and a processing unit configured to process the detection signals to detect the bundle state.

6. The apparatus according to claim 1, further comprising:

a position detection sensor configured to detect a position of the upper surface; and a guide arranged opposite to a forth side surface in a side where the one or more paper sheets are extracted, among the side surfaces, and configured to support the forth side surface, wherein the support unit adjusts the position of the upper surface to allow the paper sheets to be extracted, and the extraction condition further includes a drive condition for the support unit.

7. A bundle-state detection apparatus comprising:

a support unit configured to support a stack of paper sheets stacked in a stacking direction t the stack having an upper surface, a lower surface, and a plurality of side surfaces extending in the stacking direction;

a light emitting unit configured to emit a light beam toward a first surface selected from the upper surface and the lower surface;

a detector arranged opposite to a second surface selected from the side surfaces, and configured to detect a plurality of light intensity distributions of transmitted beams emerging from a plurality of regions on the second surface to generate a plurality of detection signals, the transmitted beams being generated by the light beam which passes through the stack; and a processing unit configured to process the detection signals to detect a bundle state of the stack, the bundle state being related to a contact state between the paper sheets.

* * * * *